US011843195B2

(12) United States Patent
Meyer

(10) Patent No.: US 11,843,195 B2
(45) Date of Patent: Dec. 12, 2023

(54) CONDUCTOR CONNECTION TERMINAL AND SOCKET INSERT

(71) Applicant: WAGO Verwaltungsgesellschaft mbH, Minden (DE)

(72) Inventor: Michael Meyer, Wiedensahl (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/726,142

(22) Filed: Apr. 21, 2022

(65) Prior Publication Data

US 2022/0344848 A1 Oct. 27, 2022

(30) Foreign Application Priority Data

Apr. 23, 2021 (DE) ..... 10 2021 110 425.4

(51) Int. Cl.
*H01R 13/11* (2006.01)
*H01R 9/24* (2006.01)
*H01R 4/48* (2006.01)

(52) U.S. Cl.
CPC ..... *H01R 13/11* (2013.01); *H01R 4/48365* (2023.08); *H01R 9/2408* (2013.01)

(58) Field of Classification Search
CPC ..... H01R 13/11; H01R 9/2408; H01R 24/78; H01R 9/16; H01R 4/4836; H01R 9/24; H01R 13/02; H01R 13/502
See application file for complete search history.

(56) References Cited

U.S. PATENT DOCUMENTS

| | | | | |
|---|---|---|---|---|
| 4,728,295 | A | 3/1988 | Henrici et al. | |
| 5,098,316 | A | 3/1992 | Koellmann et al. | |
| 6,783,403 | B2 | 8/2004 | Lafragette et al. | |
| 2019/0131724 | A1* | 5/2019 | Koellmann | H01R 4/4836 |
| 2019/0237904 | A1* | 8/2019 | Koellmann | H01R 13/633 |
| 2022/0344852 | A1* | 10/2022 | Meyer | H01R 13/516 |
| 2022/0360021 | A1* | 11/2022 | Ahldag | H01R 13/17 |

FOREIGN PATENT DOCUMENTS

| | | | |
|---|---|---|---|
| DE | 3621369 | A1 | 2/1987 |
| DE | 4003701 | A1 | 8/1991 |
| DE | 4013356 | A1 | 11/1991 |
| DE | 60300009 | T2 | 12/2004 |
| EP | 3686908 | A1 | 7/2020 |

* cited by examiner

*Primary Examiner* — Travis S Chambers
(74) *Attorney, Agent, or Firm* — Muncy, Geissler, Olds & Lowe, P.C.

(57) ABSTRACT

A conductor connection terminal with an insulating material housing having a conductor insertion opening for inserting an electrical conductor in a conductor insertion direction, with a busbar and a clamping spring, wherein the clamping spring has a clamping leg and wherein the clamping leg and the busbar form a clamping point for the electrical conductor to be clamped. The insulating material housing has a base side, wherein the base side is arranged adjacent to the side of the busbar facing away from the clamping point and wherein the base side has an opening, wherein on the side of the busbar facing away from the clamping point, two contact tabs protrude from the busbar, wherein the contact tabs are designed to contact a second electrical conductor between the contact tabs, wherein the second electrical conductor can be led through the opening of the base side between the contact tabs.

10 Claims, 5 Drawing Sheets

CONDUCTOR CONNECTION TERMINAL AND SOCKET INSERT

This nonprovisional application claims priority under 35 U.S.C. § 119(a) to German Patent Application No. 10 2021 110 425.4, which was filed in Germany on Apr. 23, 2021, and which is herein incorporated by reference.

BACKGROUND OF THE INVENTION

Field of the Invention

The present invention relates to a conductor connection terminal with an insulating material housing, wherein the insulating material housing has a conductor insertion opening for inserting an electrical conductor in a conductor insertion direction, with a busbar and a clamping spring, wherein the clamping spring has a clamping leg and wherein the clamping leg and the busbar form a clamping point for the electrical conductor to be clamped.

SUMMARY OF THE INVENTION

It is therefore an object of the present invention to create an improved conductor connection terminal.

In the case of the generic conductor connection terminal, it is proposed that the insulating material housing has a base side, wherein the base side is arranged adjacent to the side of the busbar facing away from the clamping point and wherein the base side has an opening, wherein on the side of the busbar facing away from the clamping point, two contact tabs protrude from the busbar, wherein the contact tabs are designed in such a way as to contact a second electrical conductor between the contact tabs, wherein the second electrical conductor can be guided through the opening of the base side between the contact tabs.

Through the opening in the base side and the two contact tabs, a conductor connection terminal can be provided, which allows for a second electrical conductor, in particular a contact pin or a contact tag, to be contacted in addition to contacting the first electrical conductor through the conductor insertion opening. Due to the contact tabs, an additional clamping spring for the second electrical conductor can be dispensed with. The second electrical conductor is thus electrically conductively contacted between the contact tabs.

In contrast to an additional clamping spring, the contact tabs can preferably be rigidly formed. As a result, the conductor connection terminal according to the invention can be formed particularly small and flat.

Preferably, the busbar and/or the contact tabs at least partly comprise copper.

It is conceivable that the base side and the side of the insulating material housing with the conductor insertion opening are different housing sides. The conductor insertion opening is thus arranged on one side of the insulating material housing, which is different from the base side. The side of the insulating material housing with the conductor insertion opening can be adjacent to the base side.

In particular, adjacent can mean that the base side is arranged near the busbar, so that the busbar is at a substantially constant distance from the base side. In particular, adjacent does not mean that the busbar and the base side have to touch each other. However, it is conceivable for the busbar to adjoin the base side.

The conductor connection terminal may in particular have a connection cross-section for the usual conductor cross-section of 4 $mm^2$, in particular the connection cross-section is 2.5 $mm^2$. It has been shown that a connection cross-section of 2.5 $mm^2$ can be mounted structurally on a standardized socket insert.

The contact tabs can protrude from the busbar and be bent in such a way that they extend parallel to the busbar with a free end. In particular, it is conceivable that the contact tabs protrude orthogonally from the busbar. Further advantageously, the contact tabs may be bent in the same direction.

Thus, a conductor connection terminal can be provided in a simple and constructive manner, which allows for the clamping of a second electrical conductor between the contact tabs. In particular, a flat contact tag can be inserted between the contact tabs bent in the same direction.

The conductor connection terminal may have an actuation element, wherein the actuation element is set up to open and/or close the clamping point, wherein the actuation element has an actuation arm for manual actuation, wherein the actuation arm extends along the side of the insulating material housing opposite the base side.

According to an advantageous embodiment of the invention, the conductor connection terminal has an actuation element formed as an actuation lever with an actuation arm, by which at least one clamping leg of a clamping spring can be moved from an open position to a closed position and/or vice versa. In this way, simplified operation can be provided.

The actuation element may have an actuation section, wherein the actuation section is arranged to the side of the clamping spring and wherein an actuation contour of the actuation section is in active connection with the clamping leg.

Furthermore, it is advantageous if the actuation contour is a circular or partially circular cone with a V-shaped cut-out, wherein the clamping leg protrudes with an actuation section into the V-shaped cut-out.

In this way, an actuation element can be provided that causes the first contact point to be opened and closed by lifting or lowering the clamping leg of the clamping spring.

At least one protrusion may be arranged on the base side of the insulating material housing, wherein the protrusion is snappable with a corresponding recess. Further advantageously, the protrusion may be lockable by vertical insertion into the corresponding recess and horizontal displacement within the corresponding recess.

It is conceivable that the protrusions of the conductor connection terminal are locked with corresponding recesses, wherein the conductor connection terminals can be inserted vertically into insertion openings of the recess, wherein by subsequent horizontal displacement of the conductor connection terminal, the conductor connection terminal locks in a locking position. In this case, the insertion opening of the recess can taper towards the locking position, wherein the protrusion in the resting position can at least no longer be pulled out vertically from the recess, since, for example, a wider section at the free end of the protrusion blocks it from being pulled out.

In this way, the conductor connection terminal can be snapped on the base side for further use. Since the opening is also arranged on the base side, a simultaneous contact of a second electrical conductor, which is arranged at the location of the snap-fastening, can be made by the snap-fastening.

The invention further relates to a socket insert for a socket for connecting an external conductor and/or a neutral conductor and/or a protective conductor, wherein a conductor terminal described above is arranged at the socket insert for connecting an electrical conductor.

The conductor connection terminal described above can also be used, for example, in a lamp or in a switch insert. In the case of the lamp or switch insert, only a corresponding contour and a second electrical conductor, or a contact tag, must be provided so that an electrically conductive connection can be established between these, the contact tabs of the conductor connection terminal and the corresponding switch insert or lamp.

It has been shown that the conductor connection terminal according to the invention can be used in particular on a socket insert. Through the opening in the base side, the conductor connection terminal can be provided with a corresponding electrical connection to the socket insert, so that the connection of electrical conductors via the conductor connection terminal is made possible.

In this case it is advantageous if the conductor connection terminal is arranged with an actuation element at the socket insert. In this way, the installation of electrical conductors on the socket insert can be carried out without additional tools.

In each case a conductor connection terminal for contacting the outer conductor, the neutral conductor and the protective conductor can be arranged at the socket insert. Further advantageously, the conductor connection terminal may have at least two conductor insertion openings, wherein each conductor insertion opening is associated with a clamping point for connecting an electrical conductor.

The socket insert is thus adapted to the structural conditions of a standardized electronics installation in, for example, Germany, so that in each case the outer conductor, the neutral conductor and the protective conductor are associated with a conductor connection terminal for contacting. However, it is also conceivable for the socket insert according to the invention to be adapted to the structural conditions in other countries or regions. If, for example, only two electrical conductors are provided for a socket in other countries or regions, only two conductor connection terminals can be provided for each of these electrical conductors in the plug-in contact insert according to the invention.

Due to the embodiment with two conductor insertion openings on each of the conductor connection terminals, the outer conductor, the neutral conductor and/or the protective conductor can be contacted electrically conductively for further cabling in the respective conductor connection terminal. For example, the external conductor, the neutral conductor and/or the protective conductor can be guided to another socket insert.

The socket insert may have a bearing section, wherein the conductor connection terminal can be arranged on the bearing section and wherein a contact element is arranged on the bearing section, wherein the contact element is movable between the contact tabs of the conductor connection terminal. Further advantageously, in each case a slot for a conductor connection terminal can be provided for an electrical conductor on the bearing section having the associated contact element.

In particular, the conductor connection terminal can be locked on the bearing section.

The undefined term "a" is to be understood as such and not as a number word. Thus, it is also conceivable that the conductor connection terminal has a plurality of clamping springs, in particular two, three, four or six clamping springs, wherein in each case a clamping spring with a busbar forms a clamping point for an electrical conductor to be clamped. Accordingly, a plurality of conductor insertion openings may also be arranged on the insulating material housing to guide the electrical conductors into the insulating material housing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
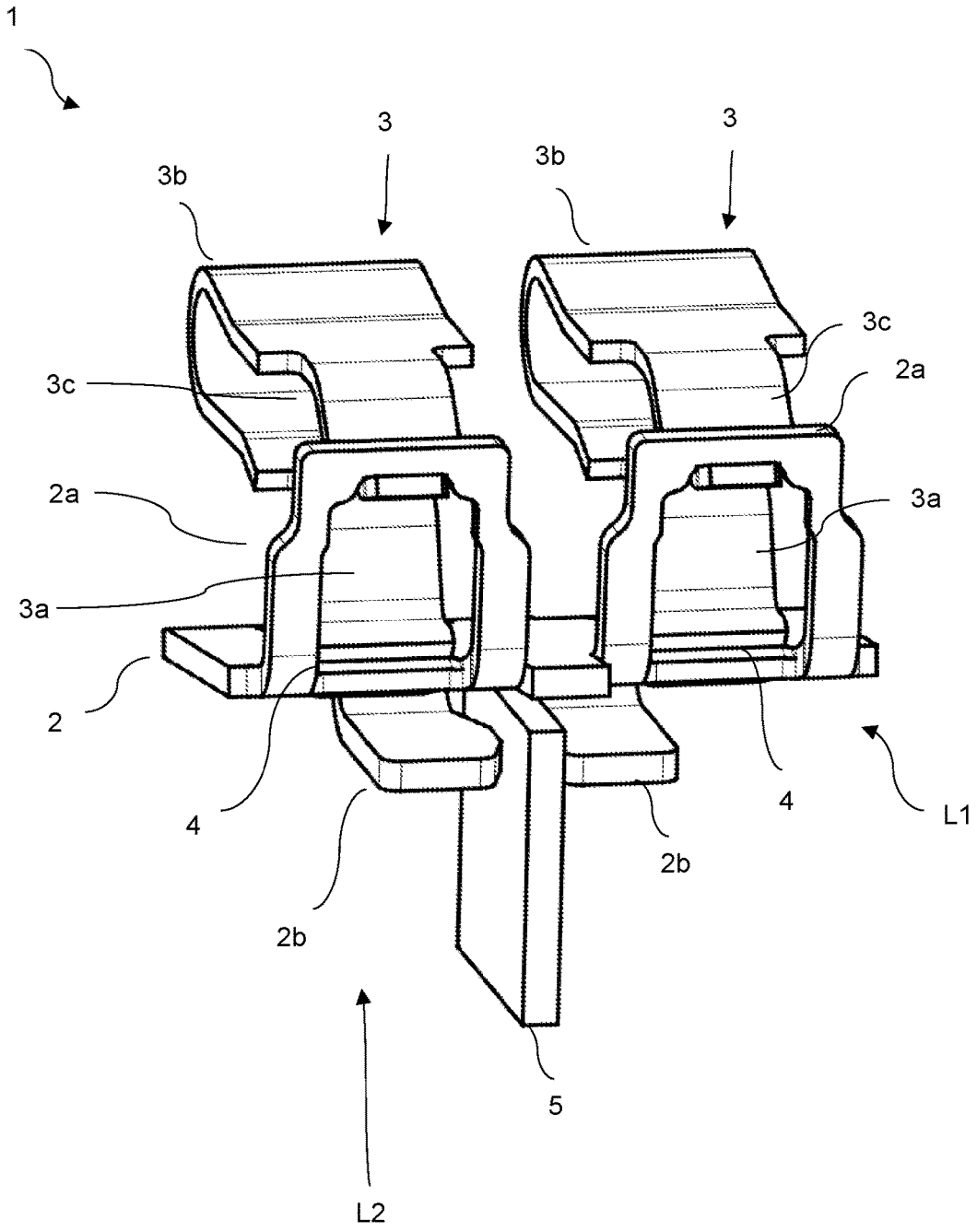
FIG. 1*a* illustrates a contact insert for a conductor connection terminal according to the invention in a perspective view.

FIG. 1*a* shows a contact insert 1 for a conductor connection terminal according to the invention, wherein the contact insert 1 has a busbar 2 and a clamping spring 3. The clamping spring 3 has a clamping leg 3*a*, wherein the clamping leg 3*a* merges into a spring arc 3*b* and extends into a contact leg 3*c*. A free end of the busbar 2 is bent in such a way that a U-shaped busbar tab 2*a* protrudes from the busbar 2, wherein the contact leg 3*c* of the clamping spring 3 is suspended in the busbar tab 2*a* and the clamping spring 3 is thus arranged to be self-supporting on the busbar 2. The clamping leg 3*a* of the clamping spring 3 and the busbar 2 further form a clamping point 4 for the electrical conductor to be clamped.

In the embodiment according to FIG. 1, a busbar 2 with two clamping springs 3 is shown, wherein in each case the clamping leg 3*a* of the clamping springs forms a clamping point 4 with the busbar 2 for an electrical conductor to be clamped. However, the number of busbars, clamping springs and related clamping points is not connected to the embodiment according to FIG. 1. Thus, one or more busbars 2 with a variety of clamping springs 3, in particular three, four or six clamping springs 3, are conceivable, each of which form a clamping point 4 for an electrical conductor to be clamped.

On the side of the busbar 2 facing away from the clamping point 4, two contact tabs 2*b* protrude from the busbar 2. The free ends of the contact tabs 2*b* are bent in such a way that the free ends extend parallel to the busbar 2. The free ends of the contact tabs 2*b* are bent in the same direction parallel to the busbar 2, wherein, for example, an opposite direction of the bent free ends of the contact tabs 2*b* is conceivable.

It becomes clear that the contact tabs 2*b* are designed in such a way that between the contact tabs 2*b* a second electrical conductor, in particular a contact tag 5 or a contact pin, can be contacted electrically conductively. A contact tag 5 or a contact pin are particularly rigid and therefore not very flexible. The contact tag 5 can be, in particular, a contact tag 5 of a socket insert. The contact tag 5 can be inserted substantially precisely between the contact tabs 2*b* of the busbar 2, so that an electrically conductive contacting can be guaranteed. Furthermore, it becomes clear that the second electrical conductor, or the contact tag 5, is contacted electrically conductively between the clamping points 4 on the side of the busbar 2 facing away from the clamping points 4. Due to the contact tabs 2*b*, no additional clamping spring is required for contacting the second electrical conductor or the contact tag 5. The contact tabs 2*b* can be formed in one piece from the busbar 2, wherein in contrast to the additional clamping spring, the contact tabs 2*b* are rigidly formed.

Figure 1B:
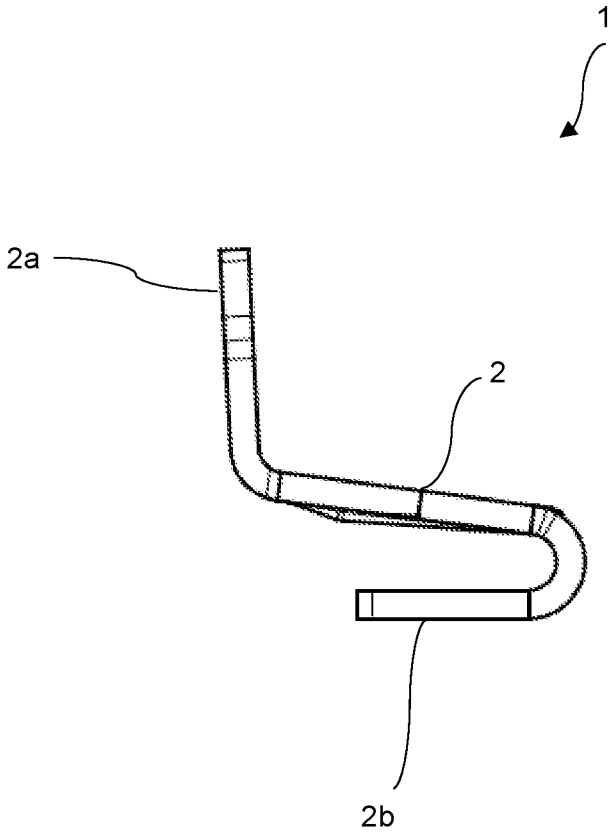
FIG. 1*b* illustrates a contact insert according to FIG. 1*a* in a side view.

FIG. 1*b* shows a contact insert 1 according to FIG. 1*a* in a side view. It becomes clear that the busbar 2 and the protruding contact tabs 2*b* are formed in one piece. The contact tabs 2*b* are bent from a free end of the busbar in such a way that the free end essentially extends parallel to the busbar 2. The bending of the contact tabs 2*b* from the busbar thus takes place essentially in a U-shape.

Figure 2:
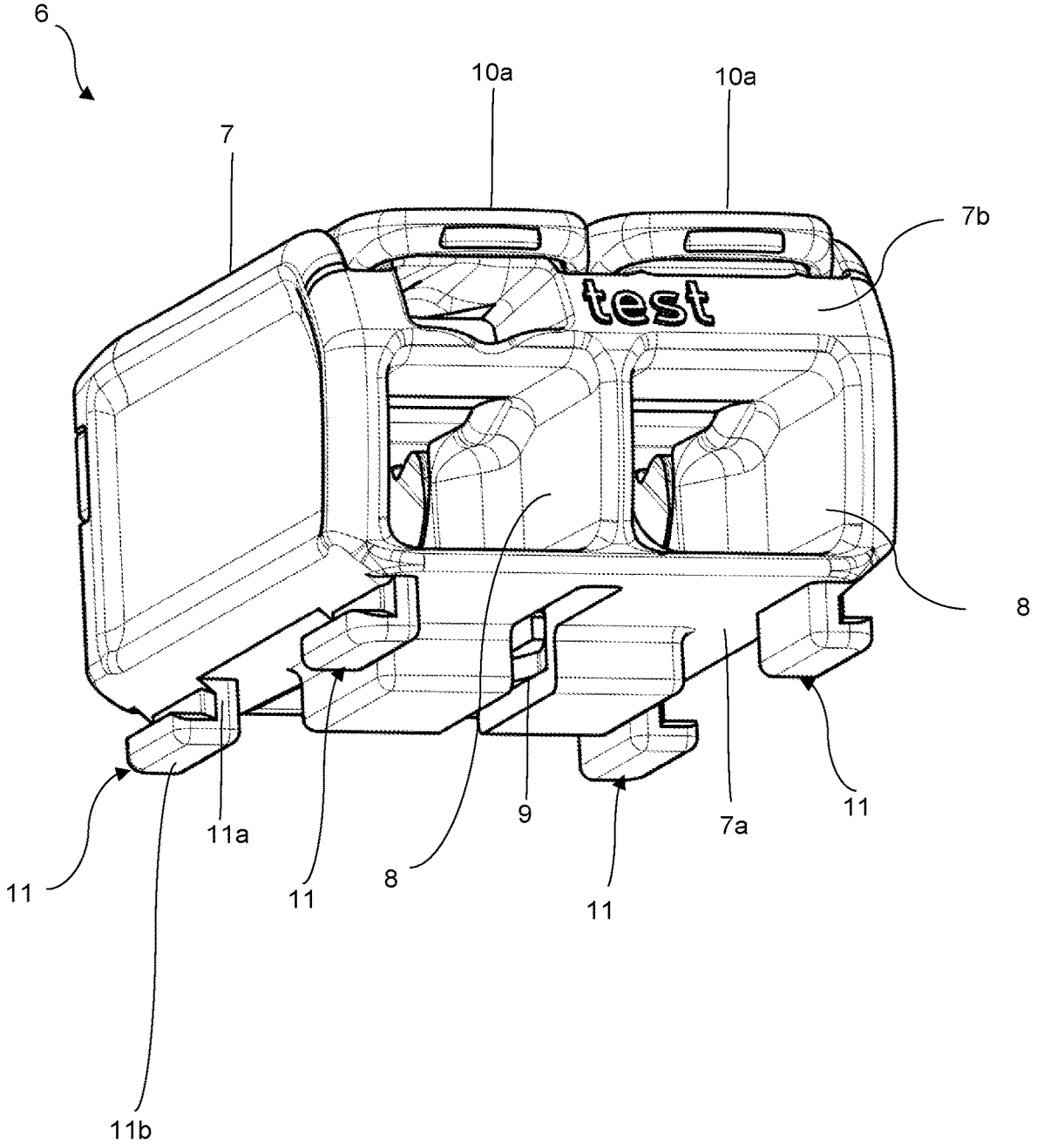
FIG. 2 illustrates a conductor connection terminal in a perspective view.

FIG. 2 shows a conductor connection terminal 6 according to the invention with an insulating material housing 7, wherein, for example, a contact insert according to FIG. 1 can be inserted into the conductor connection terminal 6. It can be seen that the insulating material housing 7 has a base side 7*a*, wherein the base side 7*a* is arranged adjacent to the side of the busbar 2 of the contact insert 1 according to FIG. 1 facing away from the clamping point 4. The contact tabs 2*b* of the busbar 2 thus protrude from the busbar 2 in the direction of the base side 7*a* of the insulating material housing 7. The insulating material housing 2 further has two conductor insertion openings 8, wherein in each case an electrical conductor can be led in a conductor introduction direction L through the conductor insertion opening 8 into the insulating material housing 2 to the respective clamping point 4 of the contact insert 1 according to FIG. 1. The conductor insertion openings 8 are arranged on a side 7*b* of the insulating material housing 7 different from the base side 7*a*. Side 7*b* of the insulating material housing 7 with the two conductor insertion openings 8 arranged next to each other is adjacent to the base side 7*a*.

It becomes clear that the base side 7*a* has an opening 9, wherein the second electrical conductor, in particular the contact tag 5 according to FIG. 1, can be led through the opening 9 into the insulating material housing 2, wherein the second electrical conductor, or the contact tag 5, can be contacted electrically conductively between the contact tabs 2*b* of the contact insert 1 according to FIG. 1. The second electrical conductor, or the contact tag 5, can be led into the insulating material housing in a second conductor insertion direction L2 essentially perpendicular to the conductor insertion direction L. The conductor connection terminal 6 thus forms a plug-in connection, which is substantially orthogonal to the plane, which is clamped by the busbar 2, for the second electrical conductor.

Furthermore, it can be seen that the conductor connection terminal has 6 actuation elements 10, wherein the actuation elements 10 are set up to open and/or close the clamping points 4. The actuation elements 10 each have an actuation arm 10*a* for manual actuation of the actuation element 10, wherein the actuation arms 10*a* extend along the side of the insulating material housing 7 opposite the base side 7*a*.

On the base side 7*a* of the insulating material housing 7 four protrusions 11 are arranged, wherein the protrusions 11 are formed for locking with a corresponding recess, in particular a recess on a socket insert. In this way, the second electrical conductor can be locked and contacted simultaneously via the base side 7*a* of the insulating material housing 7.

The protrusions 11 are L-shaped at least in a cross-section. The protrusions 11 thus each have a section 11*a* narrow in cross-section, which is narrower than a wide section 11*b* of the protrusion 11.

Figure 3:
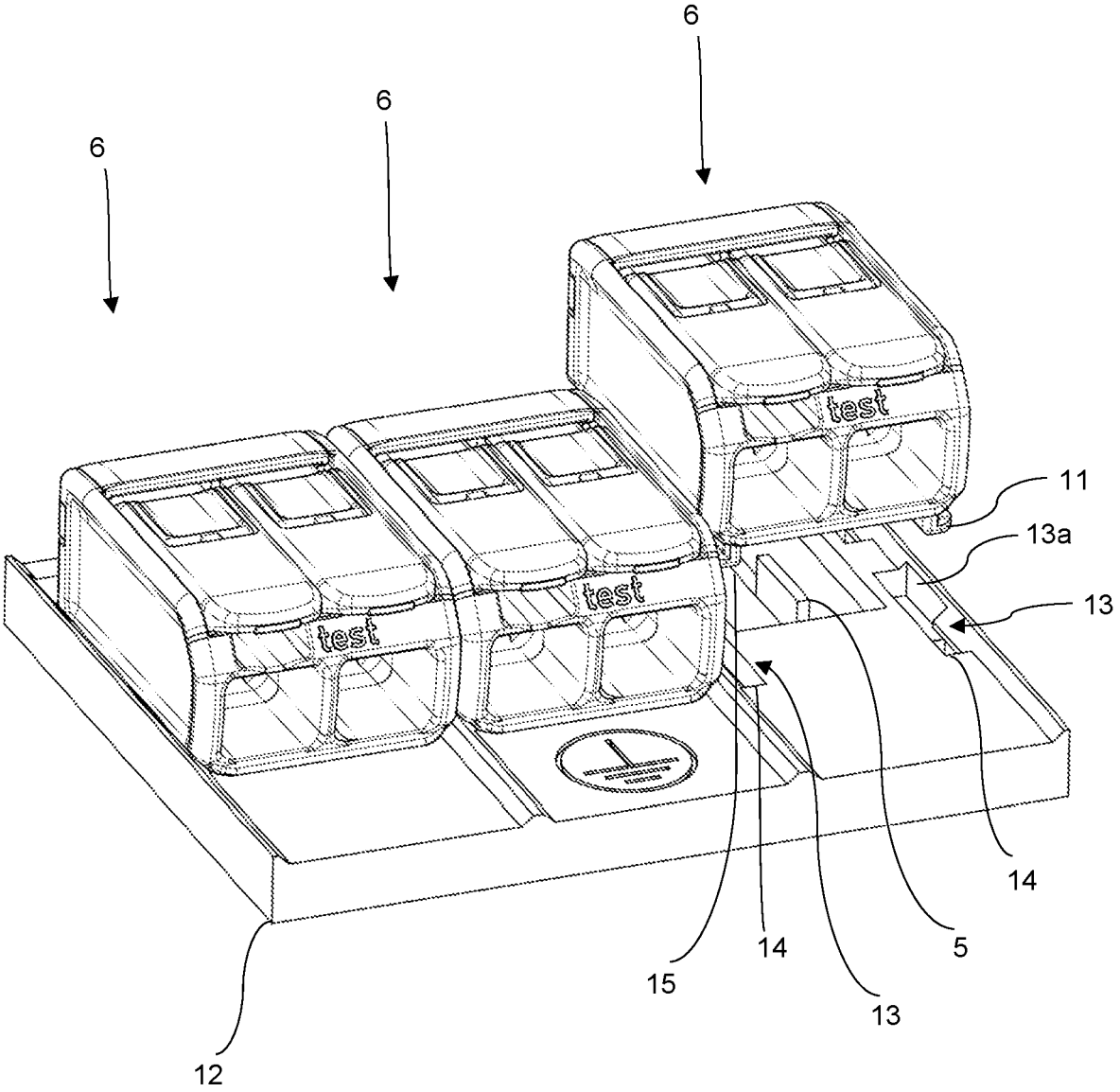
FIG. 3 illustrates a bearing section of a socket insert with conductor connection terminals according to FIG. 2 in a perspective view.

FIG. 3 shows three conductor connection terminals 6 according to the invention, wherein the conductor connection terminals 6 are arranged on a bearing section 12. The bearing section 12 is a section for the support of a conductor connection terminal, wherein the bearing section 12 is associated with a socket insert 13. The socket insert 13 with bearing section 12 and attached conductor connection terminals 6 is shown in more detail in FIG. 4. The socket insert 13 can be designed as an interface between electrical conductors laid in a house and a commercially available (depending on the country) household plug.

It becomes clear that on the bearing section 12 three slots are provided for each conductor connection terminal 6 according to FIG. 2. The protrusions 11 of the conductor connection terminals 6 can be latched in corresponding recesses 13, wherein the conductor connection terminals 6 can be inserted vertically into insertion openings 13*a* of the recess 13, wherein by subsequent horizontal displacement of the conductor connection terminal 6 the conductor connection terminal 6 locks in a locking position 14 at the bearing section 12. The insertion opening 13*a* of the recess 13 tapers towards the locking position, wherein the protrusions 11 in the locking position 14 can at least no longer be pulled out vertically from the recess 13 due to the L-shaped protrusions 11, since the wider section 11*b* of the protrusion 11 blocks it from being pulled out.

At the slots for the respective conductor connection terminals 6 is a plug opening 15 corresponding to the opening 9 of the base side 7*a* of the insulating material housing 7, wherein contact tags 5 can be led through the plug opening 15 to the respective conductor connection terminal 6.

Figure 4:
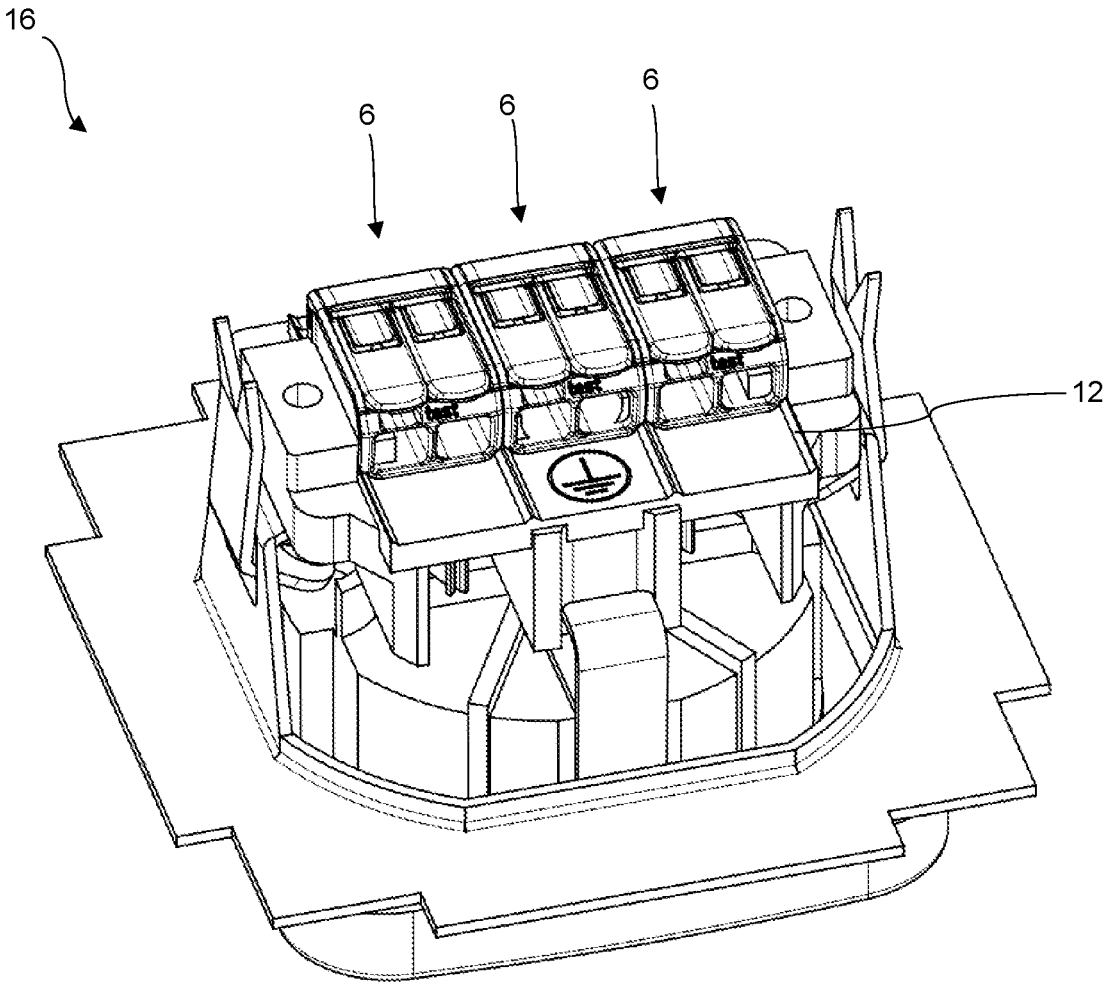
FIG. 4 illustrates a socket insert with a bearing section according to FIG. 3 in a perspective view.

FIG. 4 shows a socket insert 16 with a bearing section 12 according to FIG. 3 in a perspective view. It becomes clear that the respective contact tags form the electrically conductive connection between the conductor connection terminals 6 and the socket outlet of the socket insert 16 or a possible protective line. Based on the current German design, in each case a conductor connection terminal 6 can thus be provided for the connection of an external conductor, a neutral conductor and a protective conductor. A total of three conductor connection terminals 6 are provided at the socket insert 16. Each of the conductor terminals has two clamping points for clamping two electrical conductors.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor connection terminal comprising:

an insulating material housing having a conductor insertion opening for inserting an electrical conductor in a conductor insertion direction;

a busbar; and a clamping spring having a clamping leg, the clamping leg and the busbar forming a clamping point for the electrical conductor to be clamped, wherein the insulating material housing has a base side arranged adjacent to a side of the busbar facing away from the clamping point, wherein the base side has an opening, wherein on the side of the busbar facing away from the clamping point, two contact tabs protrude from the busbar, wherein the two contact tabs contact a second electrical conductor that is inserted between the two contact tabs, wherein the second electrical conductor is guided through the opening of the base side to be inserted between the two contact tabs, and wherein the conductor connection terminal has an actuation element, wherein the actuation element is set up to open and/or close the clamping point, wherein the actuation element has an actuation arm for manual actuation, and wherein the actuation arm extends along a side of the insulating material housing that is opposite to the base side.

2. The conductor connection terminal according to claim 1, wherein the two contact tabs protrude from the busbar and are bent such that a free end of each of the two contact tabs extends parallel to the busbar.

3. The conductor connection terminal according to claim 1, wherein the two contact tabs are bent in the same direction.

4. The conductor connection terminal according to claim 1, wherein at least one protrusion is arranged on the base side of the insulating material housing, wherein the protrusion latches with a corresponding recess.

5. The conductor connection terminal according to claim 4, wherein the protrusion latches with the corresponding recess by vertical insertion of the protrusion into the corresponding recess and horizontal displacement of the protrusion within the corresponding recess.

6. A socket insert for a socket for connecting an external conductor and/or a neutral conductor and/or a protective conductor, wherein at the socket insert a conductor connection terminal is arranged for the connection of an electrical conductor, wherein the conductor connection terminal comprises:

an insulating material housing having a conductor insertion opening for inserting an electrical conductor in a conductor insertion direction;

a busbar; and a clamping spring having a clamping leg, the clamping leg and the busbar forming a clamping point for the electrical conductor to be clamped, wherein the insulating material housing has a base side arranged adjacent to a side of the busbar facing away from the clamping point, wherein the base side has an opening, wherein on the side of the busbar facing away from the clamping point, two contact tabs protrude from the busbar, wherein the two contact tabs contact a second electrical conductor that is inserted between the two contact tabs, and wherein the second electrical conductor is guided through the opening of the base side to be inserted between the two contact tabs.

7. The socket insert according to claim 6, wherein at the socket insert, three of the conductor connection terminal are provided, a first one of the conductor connection terminals for contacting the external conductor, a second one of the conductor connection terminals for contacting the neutral conductor and a third one of the conductor connection terminals for contacting the protective conductor.

8. The socket insert according to claim 6, wherein the conductor connection terminal has at least two conductor insertion openings, wherein at least one or each of the conductor insertion openings is associated with the clamping point for the connection of the electrical conductor.

9. The socket insert according to claim 6, wherein the socket insert has a bearing section, wherein the conductor connection terminal is arranged on the bearing section, wherein the second electrical conductor is arranged at the bearing section and is inserted between the two contact tabs of the conductor connection terminal.

10. The socket insert according to claim 9, wherein, for the electrical conductor in each case, a slot for the conductor connection terminal is provided on the bearing section with an associated second electrical conductor.

* * * * *